US010410499B2

(12) United States Patent
Amir

(10) Patent No.: US 10,410,499 B2
(45) Date of Patent: Sep. 10, 2019

(54) IDENTIFYING AN IDENTITY OF A PERSON DETECTED IN A MONITORED LOCATION

(71) Applicant: Essence Smartcare Ltd., Herzlia Pituach (IL)

(72) Inventor: Ohad Amir, Herzlia (IL)

(73) Assignee: Essence Smartcare Ltd., Herzlia Pituach (IL)

( * ) Notice: Subject to any disclaimer, the term of this patent is extended or adjusted under 35 U.S.C. 154(b) by 0 days.

(21) Appl. No.: 15/356,758

(22) Filed: Nov. 21, 2016

(65) Prior Publication Data

US 2017/0148296 A1 May 25, 2017

Related U.S. Application Data

(60) Provisional application No. 62/258,558, filed on Nov. 23, 2015.

(51) Int. Cl.

| | |
|---|---|
| ***G08B 21/04*** | (2006.01) |
| ***G08B 13/24*** | (2006.01) |
| ***G08B 25/01*** | (2006.01) |

(52) U.S. Cl.

CPC ..... *G08B 21/0438* (2013.01); *G08B 13/2491* (2013.01); *G08B 25/016* (2013.01)

(58) Field of Classification Search

CPC ..... G01S 5/0252; G01S 5/14; G06K 7/0008; G06Q 20/3224; G06Q 30/02;

(Continued)

(56) References Cited

U.S. PATENT DOCUMENTS 6,574,482 B1 * 6/2003 Radomsky ..... A61B 5/1113 340/573.4
6,798,342 B2 * 9/2004 Addy ..... G08B 25/008 340/12.54

(Continued)

FOREIGN PATENT DOCUMENTS

EP 1071055 1/2001
WO WO 2012/012846 2/2012

OTHER PUBLICATIONS

European Search Report and the European Search Opinion dated Jul. 4, 2017 From the European Patent Office Re. Application No. 16199723.4. (12 Pages).

(Continued)

*Primary Examiner* — Quan-Zhen Wang
*Assistant Examiner* — Stephen R Burgdorf

(57) ABSTRACT

A system of identifying a person's identity in a monitored site, comprising communication interface(s) for communicating with motion sensor(s) each monitoring one of a plurality of monitored spaces of a monitored site, RF receiver(s), each having a reception coverage area overlapping with one of the monitored spaces and transmitter(s) for transmitting a request message, a program store storing a code and processor(s) for executing code to, receive from a detecting sensor a presence indication in a detecting space of the monitored spaces, instruct the transmitter(s) to transmit a request message in the monitored site following the indication reception and estimate an identity of a person by analyzing a unique identification signal captured by RF receiver(s) having reception coverage area that overlaps with the detecting space. The unique identification signal is transmitted by an identification device of an associated person in response to the request message reception.

10 Claims, 6 Drawing Sheets

(58) Field of Classification Search
CPC ..... G07C 9/00111; G08B 13/00; G08B 13/1427; G08B 13/2462; G08B 13/2491; G08B 21/02; G08B 21/0261; G08B 21/0438; G08B 25/016; G08B 25/10; G08B 29/185; G08B 29/188; H04L 63/08; H04L 67/12; H04L 67/24; H04W 4/006; H04W 4/02; H04W 4/028
USPC ..... 340/8.1, 539.11, 539.13, 539.23, 572.1, 340/573.1, 573.4
See application file for complete search history.

(56) References Cited

U.S. PATENT DOCUMENTS 8,253,538 B1* 8/2012 Chu ..... G06K 7/10475 340/10.1
8,395,515 B2* 3/2013 Tokhtuev ..... G06Q 10/00 340/539.13
2003/0067392 A1 4/2003 Monroe
2003/0197612 A1* 10/2003 Tanaka ..... G06K 17/00 340/572.1
2006/0208080 A1* 9/2006 Overhultz ..... G06K 7/10336 235/451
2007/0001835 A1* 1/2007 Ward ..... G07C 9/00111 340/522
2007/0046434 A1* 3/2007 Chakraborty ..... G06K 7/0008 340/10.1
2009/0295534 A1* 12/2009 Golander ..... G07C 9/00111 340/5.2
2010/0123560 A1* 5/2010 Nix ..... H04Q 9/00 340/10.4
2010/0265065 A1* 10/2010 Shimazaki ..... G06K 17/00 340/541
2010/0315243 A1 12/2010 Tokhtuev et al.
2011/0260856 A1 10/2011 Rossmann et al.
2013/0257658 A1* 10/2013 Hall ..... G01S 5/02 342/451
2015/0334530 A1 11/2015 Scott
2017/0019765 A1* 1/2017 Hoyer ..... H04B 5/0075

OTHER PUBLICATIONS

Partial European Search Report dated Mar. 29, 2017 From the European Patent Office Re. Application No. 16199723.4. (7 Pages).
Communication Pursuant to Article 94(3) EPC dated Mar. 15, 2018 From the European Patent Office Re. Application No. 16199723.4. (6 Pages).

* cited by examiner

IDENTIFYING AN IDENTITY OF A PERSON DETECTED IN A MONITORED LOCATION

RELATED APPLICATION

This application claims the benefit of priority under 35 USC § 119(e) of U.S. Provisional Patent Application No. 62/258,558 filed on Nov. 23, 2015, the contents of which are incorporated herein by reference in their entirety.

FIELD AND BACKGROUND OF THE INVENTION

The present invention, in some embodiments thereof, relates to identifying an identity of persons detected in a monitored site, and, more specifically, but not exclusively, identifying an identity of persons detected in a monitored site by associating presence detection with a unique identification signal transmitted from a personal wearable identification device.

Populations which may require attention and/or care, for example, elderly population, children, pets and/or people with disabilities may better maintain partial if not full independence as long as care person(s) such as family members and/or care personnel have constant knowledge of the well-being of the elders and/or the disabled people and that they are in no need for assistance.

Monitoring motion, movement and/or presence of the elderly people, children, pets and/or the disabled people in their natural leaving environment, for example, a home, a kinder garden, a disabled people home, an elderly residence, a retirement residence, a seniors citizens home and the likes may provide the care person(s) with information to indicate of the elderly people well-being on one hand and/or of a distress condition on the other.

SUMMARY OF THE INVENTION

According to a first embodiment of the present invention there is provided a system of identifying an identity of persons detected in a monitored site, comprising:

One or more communication interfaces for communicating with:

A plurality of motion sensors each monitoring one of a plurality of monitored spaces of a monitored site.

A plurality of RF receivers, each having a reception coverage area overlapping with a respective one of the plurality of monitored spaces.

One or more transmitters adapted for transmitting a wireless request message.

A program store storing a code; and

One or more processors coupled to the communication interface(s) and the program store for executing the code, the code comprising:

Code instructions for receiving from a detecting sensor of the plurality of motion sensors an indication of a presence detection event. The detecting sensor monitors a detecting space of the plurality of monitored spaces.

Code instructions for instructing the transmitter(s) to transmit a wireless request message in the monitored site following the indication reception.

Code instructions for estimating an identity of one of a plurality of persons by analyzing a unique identification signal captured by an RF receiver of the plurality of RF receivers having the reception coverage area that overlaps with the detecting space. The unique identification signal is transmitted in response to the wireless request message reception by an identification device of an associated person of the plurality of persons.

Correlating the detecting motion sensor(s) with the capturing RF receiver to a common monitored space may allow identifying the person(s) that triggered the motion/presence indication. Moreover, power consumption of the identification device may be significantly reduced since typically the transmitter of the identification device is turned off and is only enabled in response to the request message. This may allow, for example, increased battery life for the identification device that may typically be battery operated.

According to a second embodiment of the present invention there is provided a computer implemented method of identifying an identity of persons detected in a monitored site, comprising using one or more hardware processors of a central monitoring computing unit adapted to:

Receive an indication of a presence detection event from a detecting sensor of a plurality of motion sensors connected to the central monitoring computing unit. The detecting sensor monitors a detecting space of a plurality of monitored spaces of a monitored site.

Instruct one or more transmitters to transmit a wireless request message in the monitored site following the indication reception.

Estimate an identity of one of a plurality of persons by analyzing a unique identification signal captured by an RF receiver of a plurality of RF receivers connected to the central monitoring computing device. The RF receiver having a reception coverage area that overlaps with the detecting space. The unique identification signal is transmitted in response to the wireless request message reception by an identification device of an associated person of the plurality of persons.

Correlating the detecting motion sensor(s) with the capturing RF receiver to a common monitored space may allow identifying the person(s) that triggered the motion/presence indication. Moreover, power consumption of the identification device may be significantly reduced since typically the transmitter of the identification device is turned off and is only enabled in response to the request message. This may allow, for example, increased battery life for the identification device that may typically be battery operated.

According to a third embodiment of the present invention there is provided a system of identifying an identity of persons detected in a monitored site, comprising:

One or more communication interfaces for communicating with:

A plurality of motion sensors each monitoring one of a plurality of monitored spaces of a monitored site.

A plurality of RF receivers, each having a reception coverage area overlapping with a respective one of the plurality of monitored spaces.

A program store storing a code; and

One or more processors coupled to the communication interface(s) and the program store for executing the code, the code comprising:

Code instructions for receiving from a detecting sensor of the plurality of motion sensors an indication of a presence detection event. The detecting sensor monitors a detecting space of the plurality of monitored spaces.

Code instructions for estimating an identity of one or more of a plurality of persons by analyzing one or more unique identification signals captured by one or more capturing RF receivers of a plurality of RF receivers. The unique identification signal(s) are periodically transmitted by a respective identification device of an associated person of the plurality of persons.

Wherein the capturing RF receiver(s) having a reception coverage area overlapping with the detecting space are enabled in response to the detection event indication.

Correlating the detecting motion sensor(s) with the capturing RF receiver to a common monitored space may allow identifying the person(s) that triggered the motion/presence indication. Moreover, power consumption of the RF receivers may be significantly reduced since typically the RF receivers are turned off and are only enabled in response to the indication of the presence detection event. This may allow, for example, increase battery life in case one or more of the RF receivers are battery operated.

According to a fourth embodiment of the present invention there is provided a computer implemented method of identifying an identity of persons detected in a monitored site, comprising using one or more hardware processors of a central monitoring computing unit adapted to:

Receive from a detecting sensor of a plurality of motion sensors an indication of a presence detection event. The detecting sensor monitors a detecting space of a plurality of monitored spaces of a monitored site.

Estimate an identity of one or more of a plurality of persons by analyzing one or more unique identification signals captured by one or more capturing RF receivers of a plurality of RF receivers. The unique identification signal(s) are periodically transmitted by a respective identification device of an associated person of the plurality of persons.

Wherein the capturing RF receiver(s) having a reception coverage area overlapping with the detecting space are enabled in response to the detection event indication.

Correlating the detecting motion sensor(s) with the capturing RF receiver to a common monitored space may allow identifying the person(s) that triggered the motion/presence indication. Moreover, power consumption of the RF receivers may be significantly reduced since typically the RF receivers are turned off and are only enabled in response to the indication of the presence detection event.

According to some aspects of the first, second, third and/or fourth embodiments of the invention, the identification signal(s) are transmitted by a low power transmitter of the identification device(s) to limit a transmission range of the unique identification signal to the reception coverage area overlapping with a current-location monitored space of the plurality of monitored spaces in which the person is currently located. This may allow the identification signal(s) to be received only by the RF receiver(s) which have a reception coverage area overlapping the currently-located monitored space.

Optionally, according to some aspects of the first and/or second embodiments of the invention, a disabled transmitter of the identification device(s) is enabled for transmitting the unique identification signal following the request message. This may allow further power saving as the transmitter that may be a significant power consumption circuit may typically be tuned off and enabled only when requested.

Optionally, according to some aspects of the first, second, third and/or fourth embodiments of the invention, the reception coverage area of one or more RF receivers is adjusted to overlap an area of respective one or more monitored spaces of the plurality of monitored spaces by calibrating a receiver component of the one or more of the plurality of RF receivers. This may allow better accuracy in associating each RF receiver with its designated monitored space(s) such that each RF receiver may receive the identification signal transmitted by identification device(s) located in the designated monitored space(s).

Optionally, according to some aspects of the first, second, third and/or fourth embodiments of the invention, a location of the person is estimated by analyzing a signal strength of the unique identification signal that is received by a plurality of RF receivers. This may allow improved location detection of the identification device(s) by "triangulating" the identification device(s) according to the transmitted signal strength.

Optionally, according to some aspects of the first, second, third and/or fourth embodiments of the invention, a location of the person is estimated by analyzing a signal strength of the unique identification signal in case a multi-space RF receiver having a reception coverage area overlapping with multiple monitored spaces. This may allow improved location detection of the identification device(s) by mapping the signal strength to the distance of the identification device(s) from the multi-space RF receiver.

Optionally, according to some aspects of the first, second, third and/or fourth embodiments of the invention, one or more of the RF receivers are integrated in respective motion sensors of the plurality of motion sensors which monitor the monitored space(s) overlapping the reception coverage area(s) of the one or more RF receivers. This may allow cost reduction for the production of the motion sensors and the RF receivers as well as complexity and/or cost reduction in deploying the motion sensors and the RF receivers in the monitored site.

Optionally, according to some aspects of the first, second, third and/or fourth embodiments of the invention, the wireless request message is transmitted in a limited area comprising one or more monitored spaces of the plurality of monitored spaces. This may limit activation of only identification devices that are located in the detecting space and prevent enabling identification devices that are not located in the detecting space.

Optionally, according to some aspects of the first, second, third and/or fourth embodiments of the invention, the identification device is integrated in a mobile device used by the associated person. This may allow ease of use of the identification device while assuring the identification device is constantly carried by the associated person.

Optionally, according to some aspects of the first, second, third and/or fourth embodiments of the invention, one or more activity pattern of one or more of the plurality of persons are identified by analyzing the presence of the one or more persons over time. Identifying the activity patterns of the person(s) may allow better monitoring of the persons by recognizing their typical activity habit(s).

Optionally, according to some aspects of the first, second, third and/or fourth embodiments of the invention, a distress alert message is issued in an event one or more of the plurality of persons is detected in a single monitored space over a pre-defined time period. This may allow fast response in case the person is not mobile, in particular for cases in which the person may be an elderly and/or disabled person that may be incapable of calling for help and/or lives in a place that is not frequently visited by other people.

Optionally, according to some aspects of the first, second, third and/or fourth embodiments of the invention, an intrusion alert message is issued in an event the presence indication is determined to be triggered by a subject other than one of the plurality of persons. This may allow fast response to an intrusion that may be identified by the motion/presence indication that is not associated with a "known" person.

Optionally, according to some aspects of the first, second, third and/or fourth embodiments of the invention, one or more of the plurality of monitored locations are designated as non-presence monitored spaces, the one or more non-presence monitored spaces is not entered by the plurality of persons. This may prevent redundant analysis of monitored spaces (locations) in which the persons are not supposed to enter. This may further serve to identify an intrusion to the non-presence monitored spaces that may typically not be triggered by one of the "known" persons.

According to some aspects of the third and/or fourth embodiments of the invention, one or more of the RF receivers are disabled until enabled to allow interception of the one or more identification signals.

According to some aspects of the third and/or fourth embodiments of the invention, the capturing RF receiver(s) are enabled by the detecting sensor. This may allow fast response and/or simple implementation of the motion sensor and RF receiver coupling.

According to some aspects of the third and/or fourth embodiments of the invention, the processor executes code instructions to enable the capturing RF receiver(s). This may allow flexibility in activation of which of the RF receivers are enabled.

According to some aspects of the third and/or fourth embodiments of the invention, the unique identification signal which is transmitted by the respective identification device includes movement information of the associated person. The movement information is received from a movement sensor associated with the associated person. The movement information may allow for better monitoring of the motion patterns of the person associated with the respective identification device.

According to some aspects of the third and/or fourth embodiments of the invention, the movement sensor is integrated in the respective identification device. This may allow for simpler integration and/or implementation of the motion sensor carried by the associated person. This may also simplify the communication between the motion sensor and the identification device.

Optionally, according to some aspects of the first, second, third and/or fourth embodiments of the invention, one or more movement patterns of the associated person are identified by analyzing the movement information. Identifying the movement patterns of the associated person may allow better monitoring of the person by recognizing his typical movement habit(s).

According to some aspects of the third and/or fourth embodiments of the invention, a movement of the associated person is distinguished from a movement of one or more other persons by analyzing the movement pattern(s). By comparing the movement patterns of different persons, each person may be identified according to his typical movement pattern(s). This may serve to distinguish between a plurality of persons located at the same time in the same detecting space in which motion/presence was detected.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
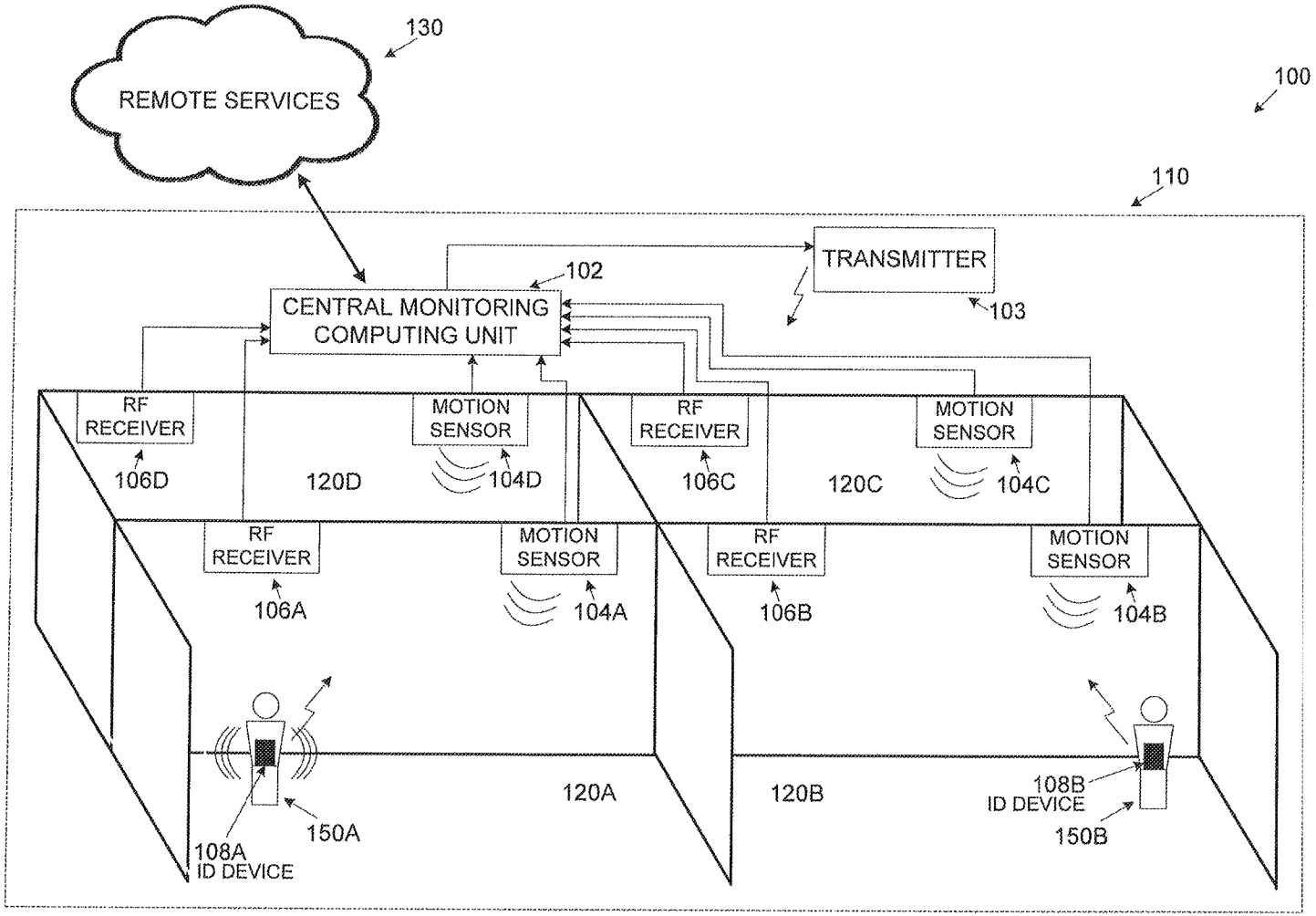
FIG. 1 is a schematic illustration of an exemplary system for identifying an identity of persons detected in a monitored site, according to some embodiments of the present invention.

The present invention, in some embodiments thereof, relates to identifying an identity of persons detected in a monitored site, and, more specifically, but not exclusively, identifying an identity of persons detected in a monitored site by associating presence detection with a unique identification signal transmitted from a personal wearable identification device.

According to some embodiments of the present invention, there are provided methods and systems for identifying an identity of one or more (monitored) persons detected in a monitored site (location) in order to accurately monitor presence, movement and/or mobility of person(s) in the monitored site by correlating between outputs of motion sensors indicative of presence and/or motion detection event(s) and wireless signals indicative of subject(s)' identity. Analyzing the detection event(s) in respect of the subject identity may allow increasing accuracy of an activity pattern such as mobility and/or presence patterns of the person(s) in the monitored site. Based on the activity pattern, well-being of the person(s), in particular elderly person(s), children, pet(s) and/or people with disabilities may be supervised using low resolution motion sensors even when other subject(s), for example, assistance stuff person(s), care person(s), pet(s) and/or visitor(s) are also present in the monitored site. This may reduce false positive detection of distress situation(s) as the presence and/or motion of the other subject(s) is not classified as a presence and/or motion of the monitored person(s).

According to some embodiments, the detection event(s) are detected using motion sensors such as passive infra-red (PIR) sensors, microwave (MW) sensors, ultrasonic sensors, imaging sensors and/or the like. The motion sensors are deployed to monitor different monitored spaces in the monitored site. The motion sensors are capable of detecting presence and/or motion of moving object(s), such as persons and animals and are in communication with a central monitoring computing unit, for instance, part of an alarm and/or security system installed in the monitored site. Following an identification of a detection event based on an analysis of outputs of the motion sensors, the central monitoring computing unit may instruct wireless transmitter(s) to transmit a wireless request message. The wireless request message is intercepted by one or more identification devices, such as wearable devices, each associated with another monitored person or animal in the monitored site. In response to the wireless request message, each intercepting identification device transmits a unique identification signal indicating an identity of the associated person or animal, for brevity referred to herein interchangeably. The wireless request message and/or the unique identification signal may be encoded according to one or more radio frequency (RF) protocols, for example, Bluetooth™, wireless local area network (WLAN) protocol, such as Wi-Fi™, ZigBee™ and/or another proprietary RF protocol.

The unique identification signal is received by one or more RF receivers operating with the appropriate RF protocol which are distributed such that the reception coverage area of each of the RF receivers overlaps an area of a monitored space. The location of the monitored person(s) is identified by analyzing the location of the receiving RF receiver(s) which received the respective unique identification signal(s) indicating the identity of the associated monitored person(s). Identification of the identity of the person(s) whose motion and/or presence triggered the detection event is made by analyzing the location of the monitored space (detecting space) in which the detection event took place compared to the location of the receiving RF receiver(s).

In the above embodiments, power consumption of the identification device is significantly reduced since the identification device(s) transmits the unique identification signal only in response to the wireless request message following the detection event(s). The unique identification signal transmission may be one of the most power consuming operations of the identification device and limiting the transmission events to take place only in response to the wireless request message may therefore significantly reduce the power consumption of the identification device compared to other methods for monitoring person(s)' activity. The other methods for monitoring person(s)' activity, for example, an identification device which periodically transmits a signal (beacon) and/or triangulation of a transmitter carried by the person(s) may require high power consumption identification devices, high power transmission (by the identification device) and/or distribution of multiple and/or high quality expensive RF receivers. The reduced power consumption as presented herein may extend a battery life of the identification device which may be a mobile, battery operated device. By extending the battery life frequent maintenance operations, for example, battery replacement and/or battery charging may be avoided. Such maintenance operations may be difficult to perform, specifically by elderly person(s), children, pet(s) and/or people with disabilities.

Optionally, the identification device(s) employs a low power transmitter which has a limited transmission range such that the unique identification signal is received by an RF receiver that is located in the monitored space in which the identification device (and hence the associated person) is located. The identification device(s) transmitter may be further calibrated to have a transmission range which is confined to an area of the monitored spaces to allow only a RF receiver(s) located in the monitored space in which the identification device is currently located to receive the transmitted unique identification signal. Usage of the low power transmitter may further reduce power consumption of the identification device thus further extending the battery life of the identification device.

Optionally, the transmitter of the identification device is typically turned off and is only turned on at interception of the wireless request message in order to transmit the unique identification signal. After transmission of the unique identification signal the transmitter is turned off again. Enabling the transmitter only for the duration of the unique identification signal transmission may further reduce power consumption of the identification device resulting in further extending the battery life of the identification device.

Optionally, the wireless request message is transmitted in a partial area of the monitored site comprising one or more of the monitored spaces rather than in the entire monitored site. Furthermore, the wireless request message may be transmitted only in the detecting space such that only identification device(s) which are currently located in the detecting space will turn on their transmitters to transmit the unique identification signal. Limiting the transmission of the wireless request message may be done by distributing transmitters with limited transmission range and transmitting the wireless request message only in selected monitored spaces, in particular in the detecting space. Limiting the transmission of the wireless request message may further reduce power consumption of the identification device(s) since only relevant identification device(s) which are located at and/or near the detecting space turn on their transmitters. Other one or more identification devices located in non-relevant monitored spaces may not turn their transmitters on thus preserving battery energy and/or power.

Optionally, one or more of the RF receivers are distributed such that their reception coverage area overlaps more than one monitored space. When receiving the unique identification signal, the signal strength, for example, received signal strength indicator (RSSI) may be analyzed to estimate the exact monitored space in which the identification device is located. The signal strength may be characterized by one or more signal characteristics, for example, power level, power loss and/or reception time which may be analyzed to identify the location of the identification device(s) from which the unique identification signal is received.

Optionally, one or more of the RF receivers are integrated in respective one or more of the motion sensors.

Optionally, one or more of the RF receivers are calibrated to adjust their reception coverage area to overlap respective one or more monitored spaces which the RF receiver(s) are required to cover, i.e. receive the unique identification signal from identification device(s) located in the respective monitored space(s).

Identifying the identity of the person(s) in the monitored site may further serve to identify and/or create an activity pattern of the monitored person(s) occupying the monitored site over time. Analyzing the activity of the person(s) compared to the generated activity pattern(s) may provide to identifying irregularities in the person(s)' activity which may indicate of a distress condition.

Moreover, since it is expected that at least some of the monitoring systems are coupled with alarm and/or security systems, the identity identification of the monitored persons may significantly reduce a false alarm rate. In case the detection event(s) is triggered by one or more of the monitored an alarm may not generated. However, in the event no monitored person ("authorized person") is detected at the detecting space the probability of a hostile intrusion may increase.

Optionally, one or more of the monitored space may be configured, either temporarily and/or permanently as non-presence spaces in which none of the monitored users is supposed to be present.

Optionally, the central monitoring computing unit is connected to one or more networks, for example, internet and/or a cellular network to provide, receive and/or share one or more remote services. The monitoring unit may provide indications to the care personnel of one or more aspects relating to the monitored person(s), for example, activity patterns, distress conditions and/or intrusion alerts.

According to some embodiments of the present invention identifying the identity of the monitored person(s) detected in the monitored site is done by analyzing the unique identification signal which is periodically transmitted by the identification devices associated with each of the monitored person(s). Following the detection event indicated by one or more detecting motion sensors, the RF receiver(s) which are normally disabled are enabled to intercept the unique identification signal(s) in the detection space. Possibly and/or typically, only the RF receiver(s) having its reception coverage area overlapping with the detecting space is enabled.

Optionally, the RF receiver(s) are enabled by the detecting motion sensor(s) in the detecting space. For example, in some embodiments the motion sensor(s) and the RF receiver(s) are collocated on the same device, thus the motion sensor(s) can turn the RF receiver on/off. Additionally and/or alternatively, the RF receiver(s) are enabled by the central monitoring computing unit.

Enabling the RF receiver(s) only when a detection event is identified may significantly reduce the power consumption of the RF receiver(s) to increase the battery life, thus greatly reducing maintenance operations, for example, battery replacement.

Optionally, the periodically transmitted unique identification includes movement information of the associated person carrying and/or wearing the respective identification device. The movement information may be available from one or more personal movement sensors, for example, an accelerometer and/or a gyroscope which are carried and/or worn by the associated person. The personal movement sensor(s) may be integrated in the identification device. The personal movement sensor(s) may also be independent and communicate with the identification device through one or more communication channels, wired and/or wireless to provide the identification device with the movement information.

Optionally, a mobility pattern is created for the monitored person(s) by analyzing the movement information included in the intercepted unique identification signal.

The movement information and/or the mobility patterns which may be created for each of monitored person(s) may allow the care person(s) to more accurately monitor and/or supervise the mobility of the monitored person(s). Furthermore, in a monitored site containing a plurality of monitored persons, the mobility pattern may allow identifying exactly which of the monitored persons triggers the detection event by analyzing the movement information and/or the mobility patterns of the monitored persons. The movement information can provide extra information and complement the identification.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wire line, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Reference is now made to FIG. 1, which is a schematic illustration of an exemplary system for identifying an identity of persons detected in a monitored site, according to some embodiments of the present invention. A monitoring system 100 includes identifies an identity of one or more monitored persons 150 in a monitored site 110. The monitoring system 100 includes a central monitoring computing unit 102, one or more motion sensors 104 each monitoring motion and/or presence in respective one or more monitored spaces 120 of the monitored site 110, a transmitter 103 and one or more RF receivers 106. The central monitoring computing unit 102 may be a processing device which has one or more processors, for example, a computer, a server and/or a cluster of processing nodes.

The motion sensors 104 and/or the RF receivers 106 connect to the central monitoring computing unit 102 through one or more wired and/or wireless interconnections, for example, local area network (LAN), serial connection, controller area network (CAN), WLAN such as Wi-Fi™, ZigBee, Bluetooth, a proprietary wired connection and/or a proprietary wireless interface such as a proprietary RF interface.

The motion sensors are capable of detecting presence and/or motion of the monitored person(s) 150 using one or more motion and/or presence detection sensors, for example, a PIR sensor, a MW sensor, an ultrasonic sensor, an imaging sensor and the likes.

Optionally, the reception coverage area of each of the RF receivers 106 overlaps a space of respective one or more monitored spaces 120, for example, the RF receiver 106A may have a reception coverage area overlapping the monitored space 120A, the RF receiver 106B may have a reception coverage area overlapping the monitored space 120B and so on.

Each of the monitored person(s) 150 is associated with a personal, mobile identification device 108 carried and/or worn by the associated person 150. The mobile identification device 108 may be a mobile, battery operated which may be worn and/or carried by the associated person 150, for example, a wrist band, a tag, a necklace and the likes. Each of the identification devices 108 includes an RF transceiver capable of transmitting a unique identification signal indicating an identity of the associated person 150. The unique identification signal is transmitted using the RF protocol employed by the RF receivers 106 so that the unique identification signal may be received by one or more of the RF receivers 106.

Optionally, each of the identification devices 108 includes a low-power transmitter which may be adapted and/or calibrated to have a transmission range overlapping the area of a current-location monitored space 120 in which the identification device 108 is currently located. This may allow only the RF receiver(s) 106 which are located in the current-location monitored space 120 to receive the unique identification signal. Using the low power transmitter may serve to better identify the location of the current-location monitored space 120 since only the RF receivers 106 located in the current-location monitored space 120 detect the unique identification signal. In addition the low power transmitter may further reduce power consumption of the identification device 108 thus further extending the battery life of the identification device 108.

The monitoring computing unit 102 may instruct the transmitter 103 to transmit a wireless request message to the identification device(s) 108 in the monitored site 110 to request the identification device(s) 108 to transmit the unique identification signal. The transmitter 103 may use the one or more RF communication protocols for transmitting the wireless request message.

Optionally, the central monitoring computing unit 102 connects to one or more remote services 130, for example, a care center, an emergency post and the likes. The central monitoring computing unit 102 may connect to the remote service(s) 130 over one or more networks, for example, the internet and/or a cellular network. Connection to the internet may be done through a local router located at the monitored site. The central monitoring computing unit 102 may connect to the router through one or more interfaces, for example, LAN and/or WLAN.

Figure 2:
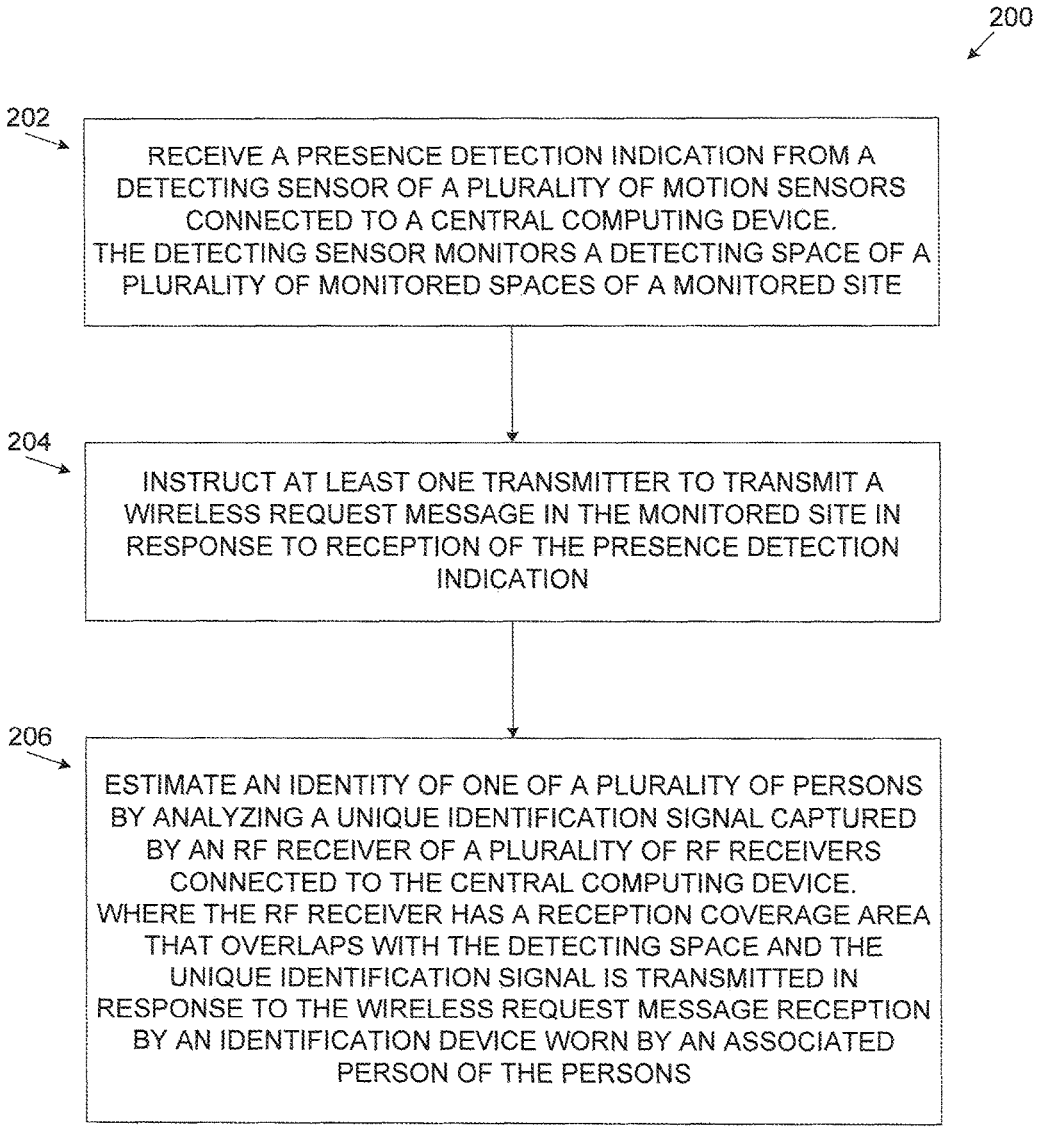
FIG. 2 is a flowchart of an exemplary process for identifying an identity of persons detected in a monitored site, according to some embodiments of the present invention.

Reference is also made to FIG. 2 which is a flowchart of an exemplary process for identifying an identity of persons detected in a monitored site, according to some embodiments of the present invention. An identity identification process 200 for identifying an identity of persons such as the persons 150 detected in a monitored site such as the monitored site 110 may be performed by a monitoring system such as the monitoring system 100.

As shown at 202, the process 200 starts with a central monitoring computing unit such as the central monitoring computing unit 102 receiving a motion and/or presence detection event indication from one or more motion sensors such as the motion sensors 104. The motion sensor 104A, for example, detects a motion and/or presence of the person 150A in the monitored space 120A which is designated a detecting space 120A.

As shown at 204, following the detection event of the person 150A in the detecting space 120A the monitoring computing unit 102 instructs a wireless transmitter such as the transmitter 130 to transmit wireless request message throughout the monitored site 110. The wireless request message may be encoded according to one or more RF protocols, for example, Bluetooth™, wireless local area network (WLAN) protocol, such as Wi-Fi™, ZigBee™ and/or another proprietary RF protocol.

As shown at 206, the wireless request message may be intercepted by one or more intercepting identification devices such as the identification devices 108. In response to the wireless request message interception each intercepting identification device 108 transmits a unique identification signal which indicates an identity of an associated person who carries and/or wears the identification device 108. For example, the identification device 108A is associated with the person 150A and the identification device 108B is associated with the person 150B. The unique identification signal may be encoded according to the appropriate one or more RF protocols used by the RF receivers 106, for example, Bluetooth™, wireless local area network (WLAN) protocol, such as Wi-Fi™, ZigBee™ and/or another proprietary RF protocol.

The unique identification signal(s) is received by one or more receiving RF receivers such as the RF receivers 106 and transferred to the central monitoring computing unit 102. Since the reception coverage area of each of the RF receivers 108 may be adapted and/or calibrated to overlap a respective monitored space 120, each of the unique identification signals may be received by the receiving RF sensor 108 which has its reception coverage area overlapping the monitored space in which the identification device 108 (and hence the associated person 150) is currently located. For example, the identification RF receiver 106A receives the unique identification signal transmitted by the identification device 108A and the RF receiver 106B receives the unique identification signal transmitted by the identification device 108B.

The central monitoring computing unit 102 may identify the identity of the person(s) 150 located in the detecting area 120 by analyzing the location(s) of the monitored person(s) 150 compared to the location of detecting space 120 in which the motion sensor 104 which issued the detection event is located. The central monitoring computing unit 102 may further calculate the location of each of the monitored person(s) 150 according to the location of the RF receiver(s) 106 which received the respective unique identification signal associated with each of the person(s) 150. For example, the location of the detecting space 120A is compared to the location of the RF receiver 106A which received the unique identification signal for the person 150A and the location of the RF receiver 106B which received the unique identification signal for the 150B. Based on the location of the RF receivers 106A and 106B the central monitoring computing unit 102 may determine that the detection event was triggered by the person 150A located in the detecting space 120A.

Optionally, the transmitter of the identification device 108 is turned off by default and is only turned on at interception of the wireless request message in order to transmit the unique identification signal. After transmission of the unique identification signal the transmitter is turned off again. Enabling the transmitter only for the duration of the unique identification signal transmission may further reduce power consumption of the identification device resulting in further extending the battery life of the identification device.

Optionally, signal strength, for example RSSI of the received unique identification signal(s) may be identified and/or analyzed to estimate a location of the originating identification device 108. In case the unique identification signal is received by more than one RF receiver 106, the signal strength of the received unique identification signal received at each of the two or more RF receivers 106 may be analyzed to estimate the location of the originating identification device 108.

Optionally, the central monitoring computing unit 102 collects activity data of one or more of the persons 150 to calculate one or more activity patterns of the person(s) 150. The activity pattern(s) may be used to verify the well-being of the person(s) 150 who follow their learned activity pattern(s) while distress condition(s) may be identified or at least suspected in case the person(s) 150 deviate from their activity pattern(s).

Optionally, one or more of the monitored space 120 in the monitored site 110 may be configured temporarily and/or permanently as non-presence spaces in which none of the monitored person(s) 150 are supposed to be present. This may present some advantages, for example, reducing the probability for a false detection (when the monitoring system is integrated and/or coupled with an alarm system). The alarm system may be configured to issue an intrusion alert only in case no monitored person(s) 150 are determined to be present in the detecting space 120.

Optionally, the central monitoring computing unit 102 connects to one or more remote services such as the remote services 130. The monitoring unit 102 may issue one or more indications to remote locations and/or services, for example, a distress alert message, an intrusion alert message and/or activity data which may be relayed to one or more care persons, for example, a family member, a care provider and/or a security person.

The distress alert message may be transmitted by the central monitoring computing unit 102 to one or more of the remote services 130 in case possible distress condition(s) are identified for one or more of the monitored persons 150. The distress condition(s) may be identified by analyzing the current location of the monitored person(s) 150 compared to the learned activity pattern(s) of the respective monitored person(s) 150. The distress condition(s) may be also identified by comparing the current location of the monitored person(s) 150 compared to a planned schedule received for example from one or more calendric tool and/or from one or more of the remote services 130. The one or more calendric tool may be available from one or more devices used by the monitored person(s) 150, for example, a Smartphone, a tablet, a laptop and the likes. The distress condition(s) may be further identified by analyzing duration of presence of the monitored person(s) 150 compared to pre-defined duration value(s). For example, a pre-defined duration value may state that a specific one of the monitored persons 150 is expected to leave the bedroom by 9:00 AM. In case the specific monitored person 150 is not detected outside his bedroom after 9:00 AM may trigger a distress condition. Another example may be, pre-defining for a specific person 150 a maximum duration of no motion detection, for example, half an hour. In case no motion of the specific person 150 is detected for half an hour a distress condition may be identified.

The intrusion distress alert message may be transmitted by the central monitoring computing unit 102 to one or more of the remote services 130 in case possible intrusion event to the monitored site is identified. The intrusion event may be identified by analyzing the current location of the each of the monitored person(s) 150 compared to the detecting space 120 in which the detection event took place. In case the central monitoring computing unit 102 determines that none of the monitored person(s) 150 is present at the detecting space 120, the detection event may be triggered by another subject(s) which may be an intruder(s). Following determination that there is a possible intrusion event, the central monitoring computing unit 102 may transmit an intrusion alert message.

Some embodiments of the present disclosure are provided through examples with reference to the accompanying drawings. However, this invention may be embodied in many different forms and should not be construed as limited to any specific structure or function presented herein. Furthermore, one or more of the exemplary embodiments may be combined to create additional embodiments.

Figure 3:
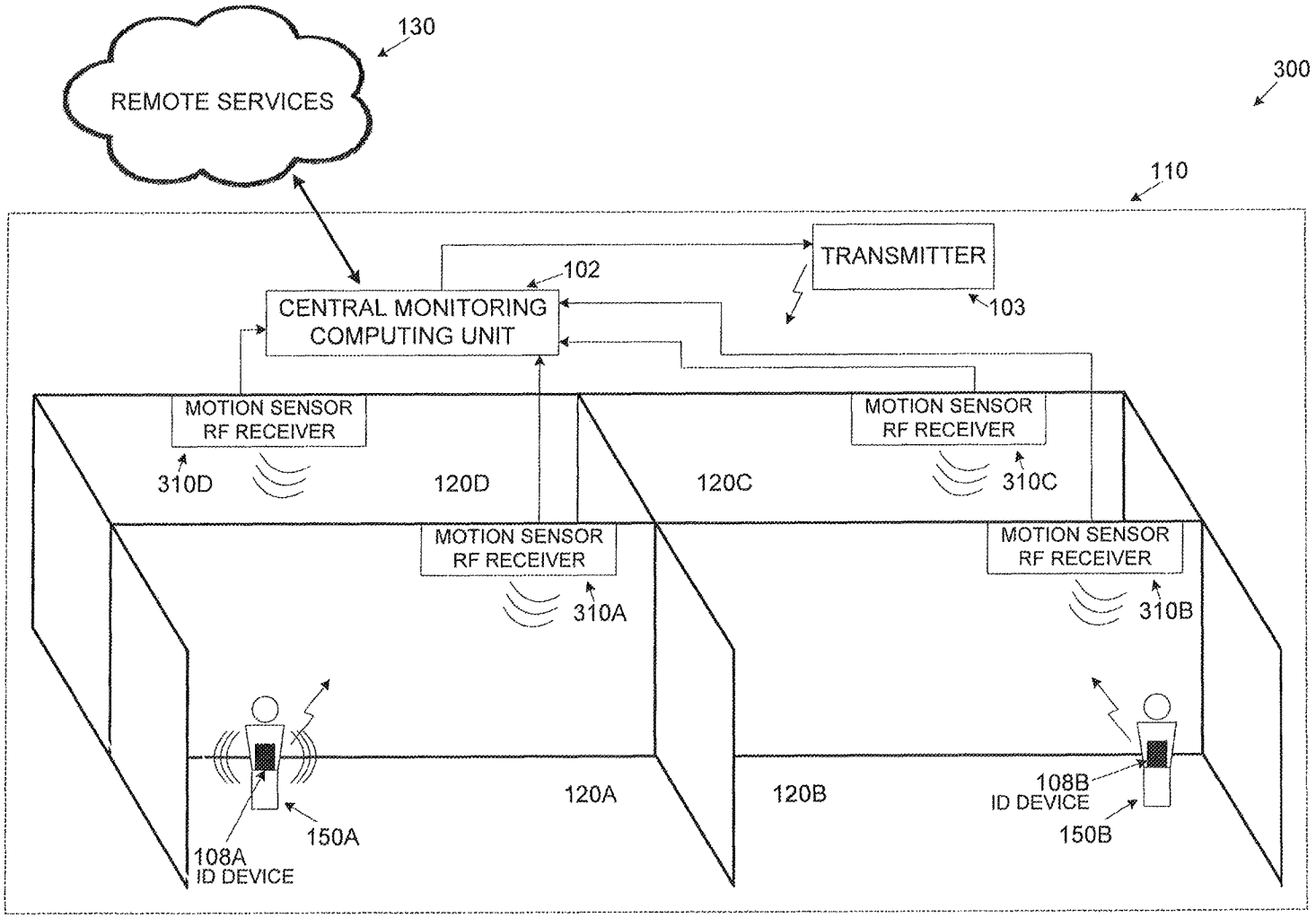
FIG. 3 is a schematic illustration of a second exemplary system for identifying an identity of persons detected in a monitored site, according to some embodiments of the present invention.

Reference is now made to FIG. 3 which is a schematic illustration of a second exemplary system for identifying an identity of persons detected in a monitored site, according to some embodiments of the present invention. A monitoring system 300 for monitoring person(s) such as the person(s) 150 in a monitored site such as the monitored site 110 provides similar functionality as the system 100. However, the system 300 includes one or more integrated motion sensors and RF receivers 310 which integrate together a motion sensor such as the motion sensor 104 and an RF receiver such as the RF receiver 106. The system 300 may present several benefits, for example, it may be easily deployed in the monitored site 110 combining a single infrastructure for both motion sensors such as the motion sensors 104 and RF receivers such as the RF receivers 106. Specifically the system 300 may be coupled with an alarm system avoiding the need for additional infrastructure. The mounting location and/or the interconnection wiring may be used for both functionalities of the integrated motion sensor and RF receiver 310.

Figure 4:
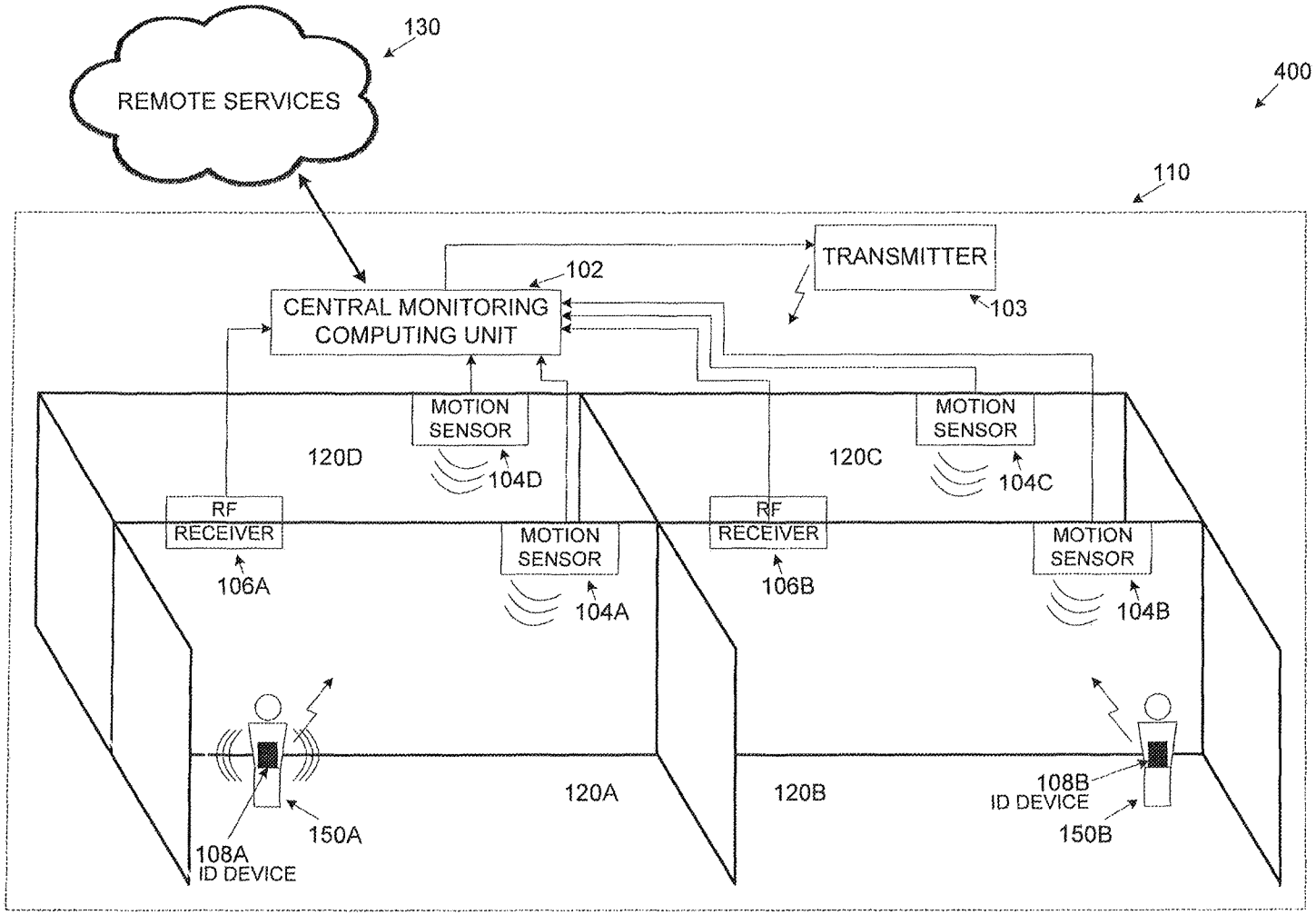
FIG. 4 is a schematic illustration of a third exemplary system for identifying an identity of persons detected in a monitored site, according to some embodiments of the present invention.

Reference is now made to FIG. 4 which is a schematic illustration of a third exemplary system for identifying an identity of persons detected in a monitored site, according to some embodiments of the present invention. A monitoring system 400 for monitoring person(s) such as the person(s) 150 in a monitored site such as the monitored site 110 provides similar functionality as the system 100. However, the system 400 includes multi-space RF receivers such as the RF receiver 106. The multi-space RF receivers 106 may be deployed such that their reception coverage area overlaps two or more monitored spaces 120. For example, the multi-space RF receiver 106A may be adapted and/or calibrated to receive a transmission of a unique identification signal which originates from an identification device such as the identification device 108 located in the monitored spaces 120A and 120D. Similarly, the multi-space RF receiver 106B may be adapted and/or calibrated to receive the transmission of the unique identification signal which originates from the identification device 108 located in the monitored spaces 120B and 120C.

Furthermore, one or more of the multi-space RF receivers 106 may be adapted to identify and/or analyze signal strength, for example, RSSI of the received unique identification signal to estimate a location of the origin identification device 108. In other embodiments, a single multi-space RF receiver 106 may be placed in the monitored site 110. The multi-space RF receiver 106 may have a reception coverage area which overlaps the entire monitored site 110. By analyzing the signal strength of the unique identification signal(s) received by the multi-space RF receiver 106, the location of each of the originating identification device(s) 108 may be estimated. Additionally or alternatively, three or more RF receivers 106 may be deployed in the monitored site to perform triangulation of the identification device 108 which transmits the unique identification signal. The system 400 may further simplify deployment of the RF receivers 106, in particular when coupling the monitoring system 400 with an alarm system.

Figure 5:
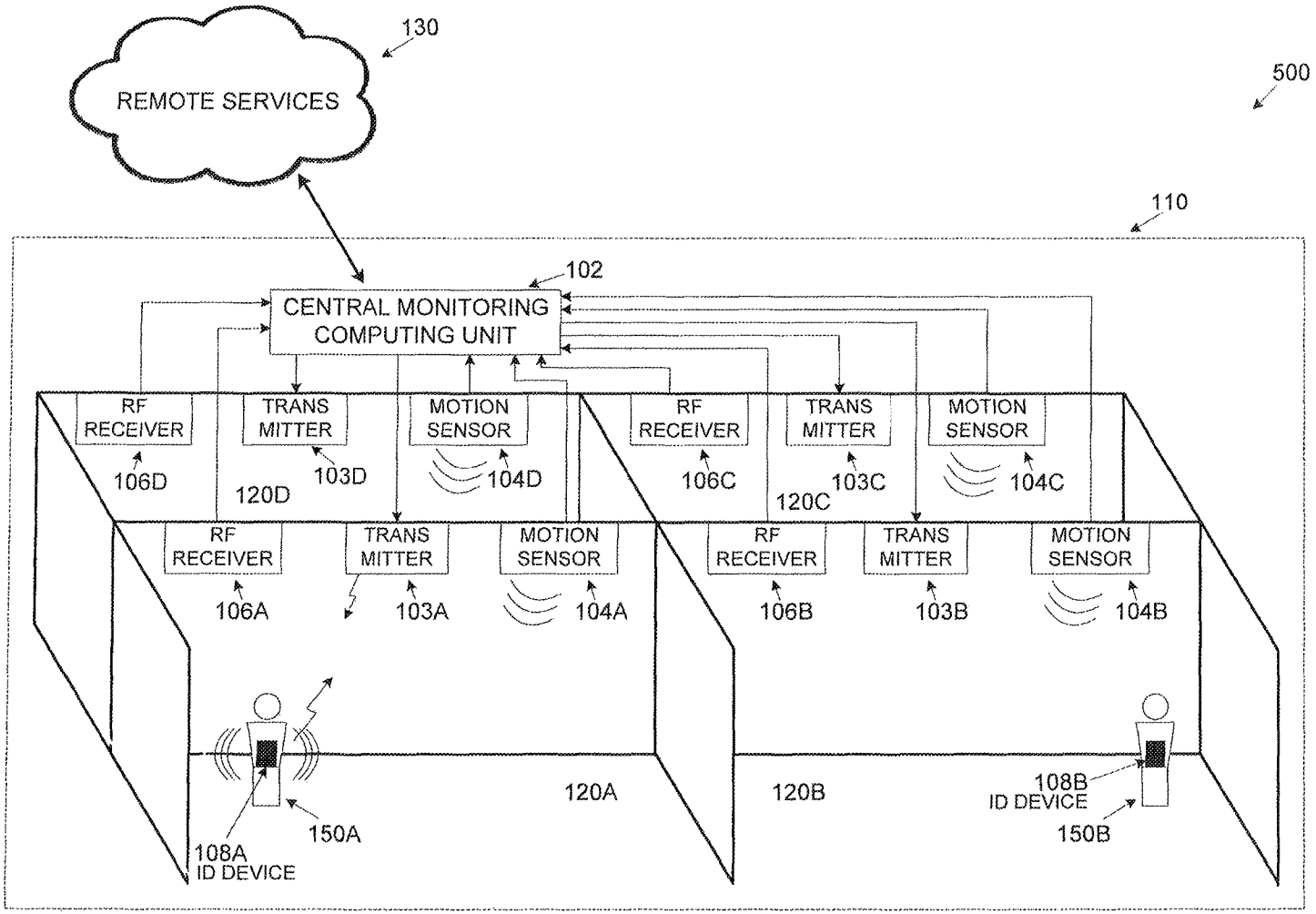
FIG. 5 is a schematic illustration of a fourth exemplary system for identifying an identity of persons detected in a monitored site, according to some embodiments of the present invention.

Reference is now made to FIG. 5 which is a schematic illustration of a fourth exemplary system for identifying an identity of persons detected in a monitored site, according to some embodiments of the present invention. A monitoring system 500 for monitoring person(s) such as the person(s) 150 in a monitored site such as the monitored site 110 provides similar functionality as the system 100. However, in the system 500, a wireless request message is transmitted by one or more transmitters 103 which are deployed such that a transmission coverage area of each of the transmitters 103 is limited to a partial area of the monitored site 110 comprising one or more monitored spaces 120. For example, the transmission coverage areas of the transmitters 103A, 103B, 103C and 103D are limited to the monitored spaces 120A, 120B, 120C and 120D respectively.

On reception of a detection event indication from one or more of motion sensors such as the motion sensors 104, a central monitoring computing unit such as the central monitoring computing unit 102 may instruct one or more of the transmitters 103 to transmit the wireless request message in a partial area of the monitored site 110 one or more monitored spaces 120 rather than throughout the entire monitored site 110. For example, on reception of the detection event indication from the motion sensor 104A located in the detecting space 120A, the central monitoring computing unit 102 may instruct only the transmitter 103A to transmit the wireless request message. The transmission range of the transmitter 103A may be adjusted and/or calibrated to be limited to the detecting space 120A and the wireless request message may therefore be intercepted only by the identification device(s) 108 which are located in the detecting space 120A, for example the identification device 108A. In response to the wireless request message the identification device 108A transmits a unique identification signal indicating an identity of the associated person 150A. Other identification device(s) such as, for example, the identification device 108B located in the monitored space 120B does not receive the wireless request message since it is not in the transmission coverage area of the transmitter 103A. The identification device 108B therefore does not transmit the unique identification signal indicating the person 150B which is not present in the detecting space 120A.

This deployment may further reduce power consumption of the identification device(s) 108 since only identification device(s) 108B which are located in the detecting space 120 and/or nearby monitored spaces 120 are requested to transmit the unique identification signal thus avoiding redundant transmissions.

According to some embodiments of the present invention identifying the identity of the monitored person(s) detected in the monitored site is done by analyzing the unique identification signal which is periodically transmitted by the identification devices associated with each of the monitored person(s). Following the detection event, the RF receiver(s) which are normally disabled are enabled to intercept the unique identification signal(s) in the detecting space.

Figure 6:
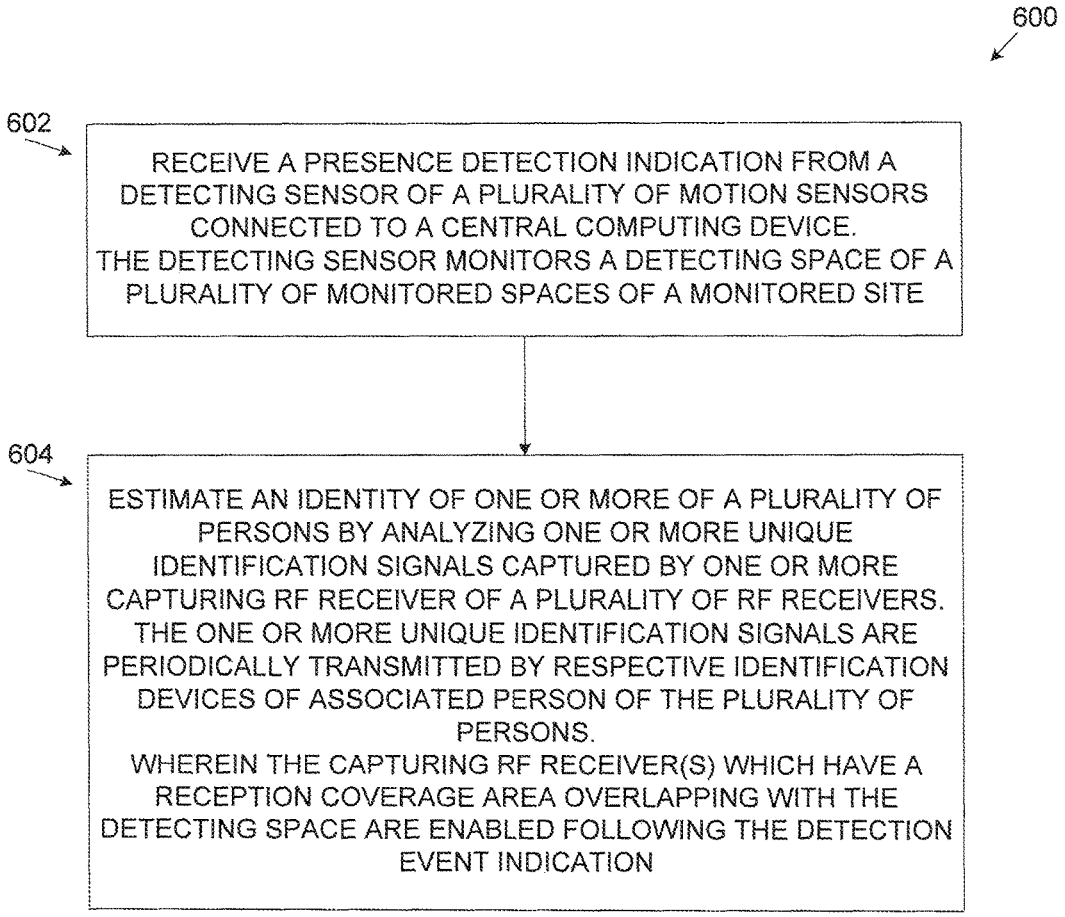
FIG. 6 is a flowchart of an exemplary process for identifying an identity of persons detected in a monitored site by analyzing a periodically transmitted unique identification signal, according to some embodiments of the present invention.

Reference is also made to FIG. 6 which is a flowchart of an exemplary process for identifying an identity of a person detected in a monitored site by analyzing a periodically transmitted unique identification signal, according to some embodiments of the present invention. An identity identification process 600 for identifying an identity of a person such as persons 150 detected in a monitored site such as the monitored site 110 may be performed by a monitoring system such as the monitoring system 100.

As shown at 602, the process 600 starts with a central monitoring computing unit such as the central monitoring computing unit 102 receiving a motion and/or presence detection event indication from one or more motion sensors such as the motion sensors 104. The motion sensor 104A, for example, detects a motion and/or presence of one or more of persons 150A in the monitored space 120A which is designated a detecting space 120A. Following the detection event, one or more of the RF receivers such as the RF receivers 106 are enabled. By default the RF receivers 106 are disabled to preserve energy and/or increase battery life. Naturally, the RF receiver(s) 106 which are enabled are those having their reception coverage area overlapping with the detecting motion sensor(s) 104. Continuing the above example, in case a presence and/or motion event is detected by the motion sensor 104A in the detecting space 120A, the RF receiver 106A is enabled. The enabled RF receiver(s) 106 may capture one or more unique identification signals which are periodically transmitted by respective one or more identification devices such as the identification devices 108 each associated with a respective one of the persons 150. For example, the identification device 108A is associated with the person 150A and the identification device 108B is associated with the person 150B. The unique identification signal may be encoded according to the appropriate one or more RF protocols used by the RF receivers 106, for example, Bluetooth™, wireless local area network (WLAN) protocol, such as Wi-Fi™ ZigBee™ and/or another proprietary RF protocol.

Optionally, only selected RF receiver(s) 106 are enabled. The selected RF receiver(s) 106 may be located in the detecting space and/or have the reception coverage area overlapping with the detecting space. For example, assuming the motion and/or presence detection event is detected in the monitored space 120A, the RF receiver 106A is enabled while other RF receivers 106 such as the RF receivers 106B, 106C and/or 106D are not enabled.

Optionally, the RF receiver(s) 106 are enabled by a central monitoring computing unit such as the central monitoring computing unit 102. The central monitoring computing unit 102 may enable the RF receiver(s) 106 after receiving the indication of the detection event from the detecting motion sensor(s) 104.

Optionally, the RF receiver(s) 106 are enabled by one or more of the indicating motion sensors 104 which indicate the detection event and/or are located within the same monitored space.

As shown at 604, the unique identification signal(s) intercepted by the enabled RF receiver(s) 106 is transferred to the central monitoring computing unit 102. The central monitoring computing unit 102 may identify the identity of the person(s) 150 located in the detecting area 120 by analyzing the location(s) of the monitored person(s) 150 compared to the location of detecting space 120 in which the motion sensor 104 which issued the detection event is located. The central monitoring computing unit 102 may further calculate the location of each of the monitored person(s) 150 according to the location of the RF receiver(s) 106 which received the respective unique identification signal associated with each of the person(s) 150. For example, the location of the detecting space 120A is compared to the location of the RF receiver 106A which received the unique identification signal for the person 150A and the location of the RF receiver 106B which received the unique identification signal for the 150B. Based on the location of the RF receivers 106A and 106B the central monitoring computing unit 102 may determine that the detection event was triggered by the person 150A located in the detecting space 120A.

The enabled RF receiver(s) 106 intercept the unique identification signal(s) in the detecting space and provide the intercepted unique identification signal(s) information to the central monitoring computing unit 102.

The central monitoring computing unit 102 may then estimate the identity of the person(s) 150 according to the intercepted unique identification signal(s) received from the RF receiver(s) 106.

Optionally, the periodically transmitted unique identification signal(s) include movement information indicating movement of the associated person 150 carrying the respective identification device 108. The movement information may be available from one or more personal movement sensors, for example, an accelerometer and/or a gyroscope which are carried and/or worn by the associated person 150.

Optionally, the personal movement sensor(s) may be integrated in the identification device 108. However, the personal movement sensor(s) may also be independent and communicate with the identification device through one or more communication channels, wired and/or wireless to provide the identification device with the movement information. The communication channels may include, for example, Bluetooth.

Optionally, one or more mobility patterns is created for one or more of the monitored persons 150 by analyzing the movement information included in the intercepted unique identification signal(s). The mobility pattern(s) may be created by the central monitoring computing unit 102 and/or they may be created off-site by one or more remote services such as the remote services 130. The mobility pattern(s) may be highly accurate as the movement information may be analyzed to distinguish between two or more persons 150 which may be present in the detecting space where some person(s) 150 may be static (i.e. not moving) while other person(s) 150 may be moving.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant systems, methods and computer programs will be developed and the scope of the term commerce information and price is intended to include all such new technologies a priori.

As used herein the term "about" refers to ±10%.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals there between.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A computer implemented method of determining identity of persons detected in a monitored site having a plurality of motion sensors each monitoring one of a plurality of monitored spaces of the monitored site, and a plurality of distributed RF receivers, each having a different reception coverage area overlapping with a respective one or more of said plurality of monitored spaces, said method comprising:

using at least one hardware processor of a central monitoring computing unit to:

receive an indication of a detection event via a wireless interface from a detecting sensor of a plurality of motion sensors connected to said central monitoring computing unit, said detection event being for a detecting space of a plurality of monitored spaces of a monitored site that is monitored by said detecting sensor;

instruct, in response to reception of said indication of said detection event via said wireless interface, a transmitter to transmit a wireless request message to all of said plurality of monitored spaces of said monitored site respectively monitored by said plurality of motion sensors, wherein in response to said wireless request message an identification device in said detecting space transmits a unique identification signal;

estimate an identity of a person carrying and/or wearing an identification device in said detecting space of said detecting sensor of said plurality of motion sensors by analyzing said unique identification signal transmitted by said identification device in response to said wireless request message and captured by an RF receiver of a plurality of RF receivers which was selectively enabled from said plurality of distributed RF receivers based on said RF receiver having a reception coverage area that overlaps with said detecting space; and estimate a location of said person by analyzing a signal strength of said unique identification signal in case a multi-space RF receiver of said plurality of RF receivers has a reception coverage area overlapping with at least two of said plurality of monitored spaces.

2. The computer implemented method of claim 1, wherein said unique identification signal is transmitted by a low power transmitter of said identification device configured to limit a transmission range of said unique identification signal to said reception coverage area overlapping with a current-location monitored space of said plurality of monitored spaces in which said person is currently located such that said identification signal is received by said RF receiver which has a reception coverage area overlapping said currently-located monitored space.

3. The computer implemented method of claim 1, wherein at least one of said plurality of RF receivers is integrated in a respective motion sensor of said plurality of motion sensors which monitors said monitored space overlapping said reception coverage area of said at least one RF receiver.

4. The computer implemented method of claim 1, wherein said identification device is integrated in a mobile device used by said person.

5. The computer implemented method of claim 1, wherein the at least one hardware processor of the central monitoring computing unit is used to identify at least one activity pattern of said person by analyzing a detected mobility and/or presence of said person over time.

6. The computer implemented method of claim 1, wherein the at least one hardware processor of the central monitoring computing unit is used to issue a distress alert message in an event said person is detected in a single monitored space over a predefined time period.

7. The computer implemented method of claim 1, wherein said RF receiver is enabled by said detecting sensor.

8. A computer implemented method of determining identity of persons detected in a monitored site having a plurality of motion sensors each monitoring one of a plurality of monitored spaces of the monitored site, and a plurality of distributed RF receivers, each having a different reception coverage area overlapping with a respective one or more of said plurality of monitored spaces, said method comprising:

using at least one hardware processor of a central monitoring computing unit to:

receive an indication of a detection event via a wireless interface from a detecting sensor of a plurality of motion sensors connected to said central monitoring computing unit, said detection event being for a detecting space of a plurality of monitored spaces of a monitored site that is monitored by said detecting sensor;

instruct, in response to reception of said indication of said detection event via said wireless interface, a transmitter to transmit a wireless request message to all of said plurality of monitored spaces of said monitored site respectively monitored by said plurality of motion sensors, wherein in response to said wireless request message an identification device in said detecting space transmits a unique identification signal;

estimate an identity of a person carrying and/or wearing an identification device in said detecting space of said detecting sensor of said plurality of motion sensors by analyzing said unique identification signal transmitted by said identification device in response to said wireless request message and captured by an RF receiver of a plurality of RF receivers which was selectively enabled from said plurality of distributed RF receivers based on said RF receiver having a reception coverage area that overlaps with said detecting space; and estimate a location of said person by analyzing a signal strength of said unique identification signal in case a multi-space RF receiver of said plurality of distributed RF receivers has a reception coverage area overlapping with at least two of said plurality of monitored spaces.

9. The computer implemented method of claim 8, further comprising identifying at least one activity pattern of said person by analyzing a detected mobility and/or presence of said person over time.

10. The computer implemented method of claim 8, further comprising transmitting a distress alert message in an event said person is detected in a single monitored space over a pre-defined time period.

* * * * *